United States Patent [19]

Janis

[11] Patent Number: 4,964,430

[45] Date of Patent: Oct. 23, 1990

[54] WALKING AID ICE GRIPPER

[76] Inventor: William F. Janis, 980 Montgomery Rd. #15, Altamonte Springs, Fla. 32714

[21] Appl. No.: 351,576

[22] Filed: May 15, 1989

[51] Int. Cl.[5] ..... A45B 9/06; A61H 3/02

[52] U.S. Cl. ..... 135/78; 135/79; 135/67; 135/68

[58] Field of Search ..... 135/65, 67, 68, 66, 135/78, 79, 77

[56] References Cited

U.S. PATENT DOCUMENTS

| | | | |
|---|---|---|---|
| 2,799,287 | 7/1957 | Wagner | 135/77 |
| 2,812,950 | 11/1957 | Holloway | 135/66 |
| 3,443,569 | 5/1989 | Ernst | 135/66 |
| 4,556,075 | 12/1985 | Hoffman | 135/65 |

FOREIGN PATENT DOCUMENTS

| | | | |
|---|---|---|---|
| 499091 | 1/1954 | Canada | 135/78 |
| 1566505 | 11/1970 | Fed. Rep. of Germany | 135/78 |
| 591827 | 9/1977 | Switzerland | 135/77 |

*Primary Examiner*—Henry E. Raduazo

*Attorney, Agent, or Firm*—Edward M. Livingston

[57] ABSTRACT

A walking aid is provided with an ice-gripper foot attachable to either the shaft of a walking aid or to an existing foot on a walking aid. The ice gripper is a toothed tubular member. One embodiment is a walking cane with the tubular ice-gripper member attached in back-to-back and end-to-end relationship to a separate walking cane for convenient use of either end of the walking cane.

13 Claims, 3 Drawing Sheets

WALKING AID ICE GRIPPER

BACKGROUND OF THE INVENTION

This invention relates to walking canes, crutches and other walking aids and more particularly to an apparatus that prevents slippage of the shaft of a walking aid on ice or packed snow.

Slippage of a walking aid on ice is a dangerous peril to the handicapped who depend on walking aids. Prior devices to prevent or to decrease slippage on ice have been comprised of sharp points that are generally retractable and built into the shaft of the walking aid. All are relatively expensive in comparison to the cost of a simple walking cane. Some are quite heavy for an item in which weight is crucial.

Included in the prior art is U.S. Pat. No. 4,434,808 which teaches a separate handle parallel to a handle on a walking aid for actuating metal points at the shoe of the walking aid. U.S. Pat. No. 4,411,284 describes a slidable and rotatable tip for walking aids. Earlier U.S. Pat. No. 619,235 explained a circular toothed band that was integrated into the end of a shaft of a walking aid in a manner that it could be slid down to be used or raised when not in use. Between the time of that earlier patent and the more recent devices, a variety of others have provided methods of projecting retractable metallic members from the inside of, from the outside or at the side of shafts of walking aids.

SUMMARY OF THE INVENTION

One object of this invention is to provide a walking-aid ice-gripper that is light in weight when either attached to a walking aid or when carried or stored for attachment when desired.

Another object of this invention is to provide a walking-aid ice-gripper that is easily and conveniently attachable to any existing walking aid.

Another object of this invention is to provide a walking-aid ice-gripper that can be constructed to fit onto nearly all types of present walking-aid shoes.

Another object of this invention is to provide a walking-aid ice-gripper that can be constructed to fit nearly all types of present walking-aid shafts, including canes, crutches and walker.

Another object of this invention is to provide a walking-aid ice-gripper that can be attachable to a walking cane which can be attached back-to-back and end-to-end to another walking cane for convenient and low cost use of whichever is most suitable to walking conditions.

The apparatus to accomplish these and other objectives consists of a circular toothed ice-gripper member with means for attachment to the downward end of a walking aid. The means for attachment can be constructed similarly for attachment onto an existing walking-aid shoe or walking-aid shaft but in different sizes and with other minor alterations as described. When left on the shoe or the shaft of a cane used for a walking aid, the cane shaft can be attached in back-to-back and end-to-end relationship to a second cane such that the ice-gripper need not be disassembled for use in icy conditions and in normal quarters where there are floors.

Typically, the toothed portion of the ice-gripper appears similar to the form of a circular hole saw but is constructed differently. The edges of the teeth are not bevelled for cutting as for saw teeth. If they were bevelled for cutting, they would cut objects in a radial direction that would not aid ice-gripping but would endanger objects that may be contacted by the ice-gripper. The teeth are not bent outwardly or inwardly as necessary to varying amounts for different types of saws. To bend them inwardly or outwardly would decrease their contact effectiveness with ice and would cause them all the more to endanger objects that may be contacted by the ice-gripper. Still further different from a saw, the construction of the circular portion above toothed members is either slotted linearly, bevelled inwardly or left open linearly at ends for attachment to the various sizes and forms of walking aids for which it is constructed for attachment.

DESCRIPTION OF THE DRAWINGS

The exact nature of this invention is set out in claims which are described in relationship to a description of preferred embodiments and the following drawings wherein:

DESCRIPTION OF THE PREFERRED EMBODIMENTS

Figure 1:
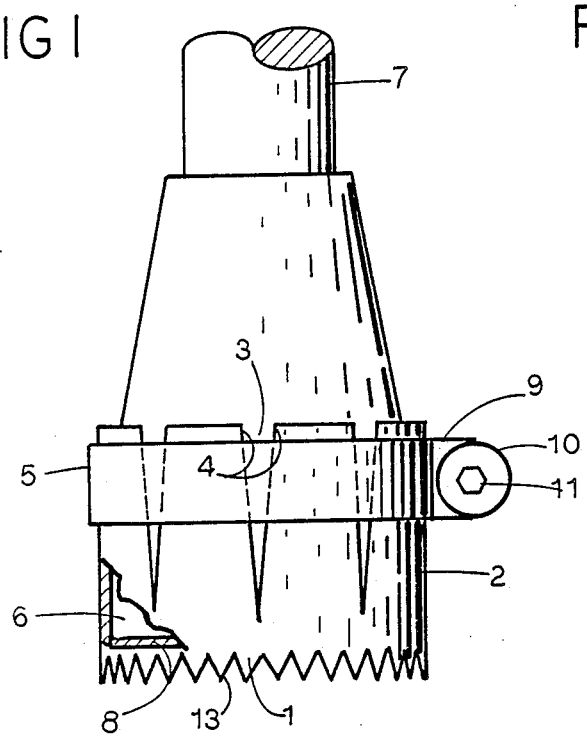
FIG. 1 is a cutaway side plan view of an embodiment of this invention that is attachable to an existing shoe on the shaft of a walking aid.

Referring to FIG. 1, toothed members 1 are projected from a tubular gripper member 2 having linear openings 3 with opposite sides 4 that are drawn towards each other by adjustable strap 5 for attachment to an existing shoe 6 on a walking-aid shaft 7. A base member 8 is provided to prevent the shoe 6 from passage through the tubular gripper member 2 and to provide an effectively snug means for attachment to the shoe 6.

The adjustable strap 5 can be constructed with a conventional bolt-and-nut assembly or with a conventional externally threaded member rotatably attached to one end of an adjustable strap and the other end constructed with matching slots according to well-known methods. In either case, an externally-threaded member would be rotatably attached to one end of the strap 5 and the other end would be provided with a matching threaded member. Either of these well-known methods for adjustment of the length of a fastener strap are represented by adjustment means 9 having optional hand-turnable knob 10 and hex-wrench hole 11. A screw-driver slot also could be employed in place of either the knob 10 or the hex-wrench hole 11.

The entire ice-gripper or separate parts of it can be provided with a soft surface by dipping into a liquid which later turns to a pliable covering during the process of construction. Such covering is not shown separately because it is considered to be incorporated into the parts as shown.

Figure 2:
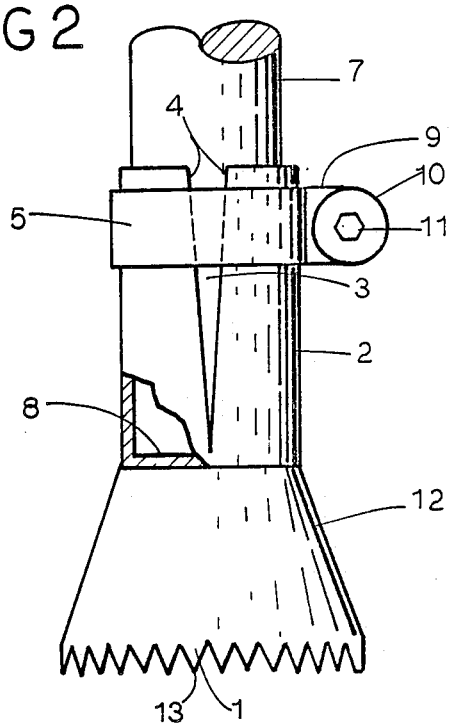
FIG. 2 is a cutaway side plan view of an embodiment of this invention that is attachable to the shaft of a walking aid.

Referring to FIG. 2, an outwardly-extended section 12 on the tubular gripper member 2, which can be the form of a truncated cone, is positioned between the toothed members 1 and straight portion of the tubular gripper member 2 for an embodiment of the invention for attachment directly to a walking-aid shaft 7 rather than to an existing shoe 6. For this embodiment of the invention, the base member 8 is positioned at the juncture of the outwardly-extended section 12 of the tubular member 2 where it prevents the shaft 7 from passing through the ice-gripper section 12. In this embodiment, similar means for attachment are provided with linear openings 3 with opposite sides of the linear openings that can be drawn towards each other by adjustment means 9.

Figure 3:
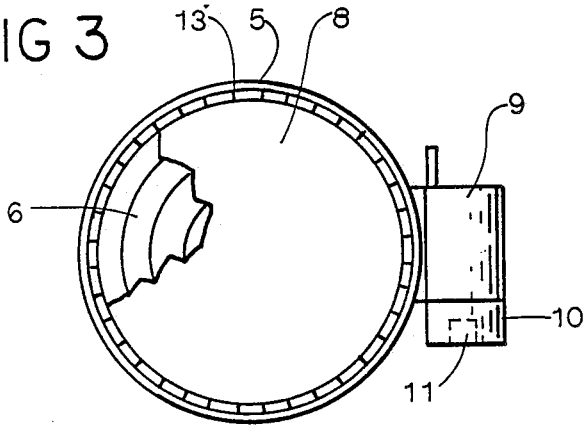
FIG. 3 is a bottom view of the embodiment of the invention that is attachable to an existing shoe on the shaft of a walking aid as shown in FIG. 1.

Referring to FIG. 3 which shows a bottom view of FIG. 1, the adjustable strap 5 with adjustment means 9 is shown from the bottom in relationship to points 13 of the toothed members 1 on tubular gripper member 2 when encompassing an existing shoe 6. Non-slip grooves in the bottom of the shoe 6 are shown through a cutaway in base member 8.

Figure 4:
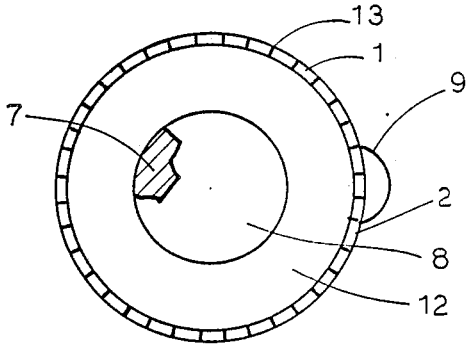
FIG. 4 is a bottom view of the embodiment of the invention that is attachable to the shaft of a walking aid as shown in FIG. 2.

Referring to FIG. 4, the points 13 of the toothed members 1 are shown from the bottom in relationship to the outwardly-extended section 12 and the base member 8 from the bottom of the embodiment shown in FIG. 2. The shaft 7 is shown through a cutaway section of the base member 8. A portion of the adjustment means 9 is shown extending beyond the outside diameter of the tubular gripper member 2.

Figure 5:
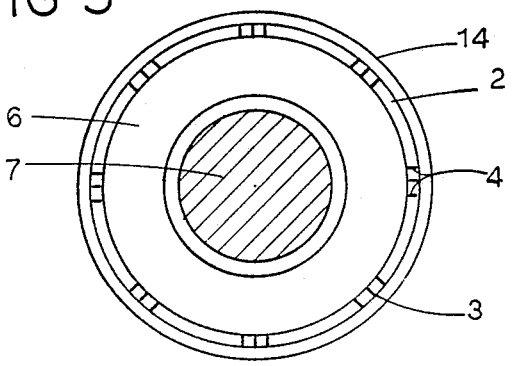
FIG. 5 is a top view of an embodiment of the invention attachable to an existing shoe on a walking aid but with a different means for attachment than for the embodiment of the invention shown in FIG. 1.

Referring to FIG. 5, a resilient band 14 is shown encompassing the outside diameter of the tubular gripper section 2 from the top. The linear openings 3 are optional in the event that the tubular section is itself a relatively resilient member. The resilient band 14 can be built into the tubular gripper member 2 such that the tubular gripper member 2 and the resilient band 14 are the same component. Also illustrated are the existing shoe 6 and cross section of a shaft 7 from the top.

Figure 6:
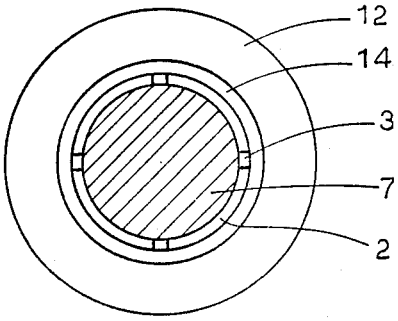
FIG. 6 is a top view of an embodiment of the invention that is attachable to the shaft of a walking aid in a manner similar to that for attachment to an existing shoe on a walking aid as shown in FIG. 5.

Referring to FIG. 6, resilient band 14 in relationship to a tubular gripper member 2 designed to encompass a walking-aid shaft 7 is shown in relationship to an outwardly-extended section 12 from the top. As in the FIG. 2 embodiment of this invention, linear openings 3 can be omitted if the tubular member 25 is constructed of sufficiently resilient material for the resilient band 14 to be built into the tubular gripper member 2.

Figures 7, 8, 9, 10:
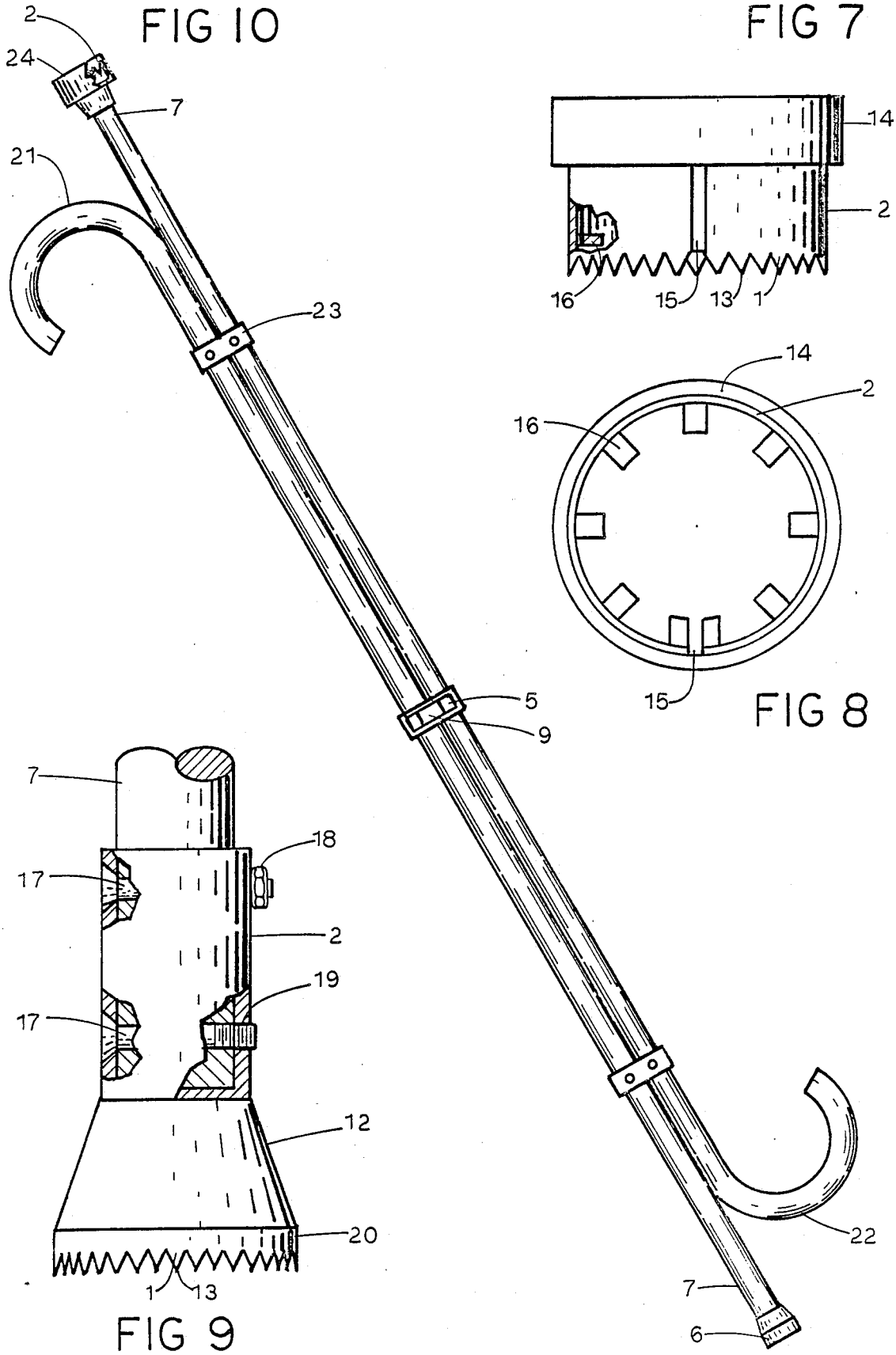
FIG. 7 is a cutaway side view of an embodiment of the invention with still a different means for attachment to an existing shoe on a walking aid.
FIG. 8 is a top view of the embodiment of the invention shown in FIG. 7.
FIG. 9 is a cutaway side view of an embodiment of this invention for more permanent attachment to the shaft of a walking aid.
FIG. 10 is an embodiment of this invention in back-to-back and end-to-end relationship of two walking canes.

Referring to FIG. 7, a tubular gripper member 2 is shown from the side with an end-to-end linear opening 15 and a resilient band 14 to draw opposite sides of the linear opening 15 towards each other to achieve a firm attachment means. This embodiment of the invention is for attachment to the outside periphery of an existing shoe 6. When this embodiment of the invention is employed, a multiple-sectioned base member 16 is employed to allow contraction of the tubular member 2 at the position of the toothed members 1.

Referring to FIG. 8, a resilient band 14 is shown from the top of the FIG. 7 embodiment in relationship to a tubular member 2 having an end-to-end linear opening 15 and a multiple-sectioned base member 16.

Referring to FIG. 9, a tubular member 2 is shown in relationship to attachment to shaft 7 with bolts 17 which can be threaded into either nut 18 or threaded orifice 19. The toothed members can be provided with a tooth base 20 which can be welded, press-formed or otherwise constructed for attachment to the outwardly-extended or truncated-cone section 12.

Referring to FIG. 10, a walking-aid cane 21 with an existing shoe 6 can be attached to a walking-aid cane 22 with a tubular gripper member 2 having toothed members attached to either a shaft 7 or a separate existing shoe 6. The attachment means can be either a bolted clamp 23, a conventional adjustment strap 5 with adjustment means 9 or other conventional means. The fastener means can be coated or otherwise covered with a pliable or soft material to protected against scratching and injury the same as for the tooth members employed at the tubular gripper member 2. A removable cover or bag 24 made of protective soft material can be utilized to cover whichever end of the invention is not being used at any time.

It is apparent that a more convenient, low-cost effective ice-gripper is provided by this invention. A variety of forms and modifications of this invention are foreseeable in accordance with the following claims.

Figure 11:
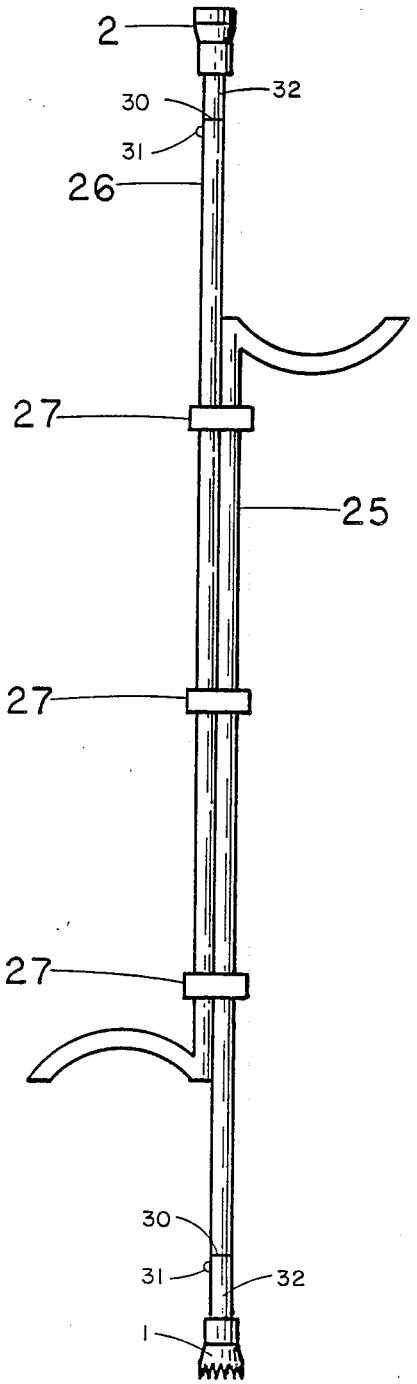
FIG. 11 is a side view of two crutch-type walking aids in back-to-back and end-to-end relationship using this invention.

Referring to FIG. 11, a toothed member 1 is attachable to one end of one crutch-type walking aid 25 and a conventional or existing shoe 6 is attached to an opposed crutch-type walking aid 26. Adjustable handle-clamps 27 can be provided to double as both handles for gripping the crutches and for clamps to hold the walking aids together. Preferably this walking aid would also be extensible to adjust for the differing heights of any user. As shown in FIG. 11, this device could be extensible by having a slightly smaller extension piece 32 on either or both ends which telescopically moves in and out from the extension point 30 by means of depressing and releasing a button 31 until it resets into round holes (not shown) on the extension piece 32 once the user obtains the desired length.

Figure 12:
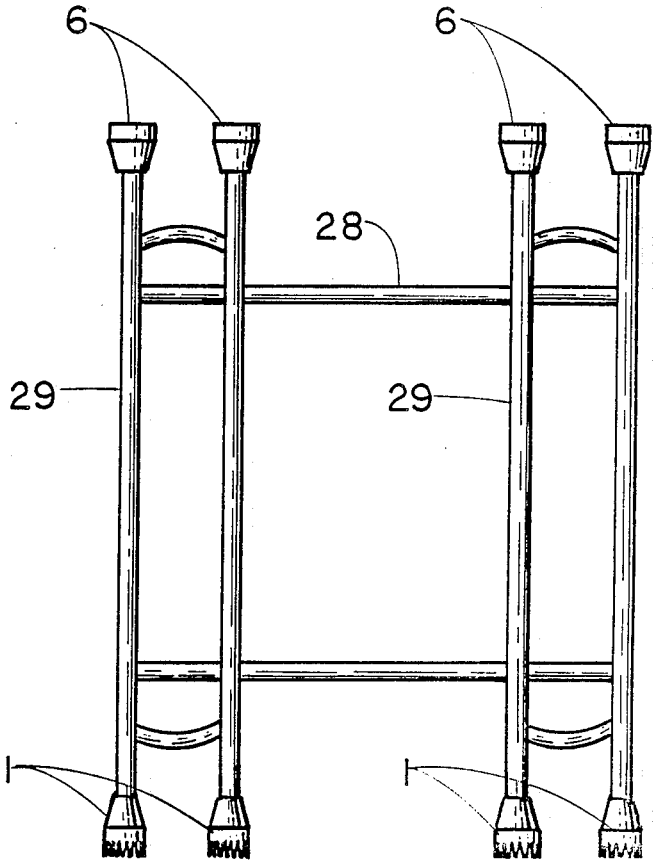
FIG. 12 is a side view of a walker on which this invention is used.

Referring to FIG. 12, a walker 28 can be provided with toothed members 1 at one end of walker vertical members 29 and conventional or existing shoes 6 at the opposite ends of walker vertical members 29.

I claim:

1. An ice-gripper for a walking-aid having a downward end with an outside periphery, said ice-gripper comprising:

a solid tubular gripper member of hard material having first and second ends said first end sized and shaped to fit over the outside periphery of the downward end of said walking aid, said tubular member having one or more selectively sized linear openings extending from said first end into said solid tubular gripper member and permitting the solid tube to be compressed over said outside periphery;

a series of pointed edges circumferentially around said second end of said solid tubular member;

a base member projected radially inward from the inside periphery of the tubular gripper member; and a ring-like strap member for securely attaching the tubular member to the downward end of a walking aid, said strap member being sized to fit around the tubular member over the linear openings and having means for drawing opposite sides of the openings towards each other radially.

2. An ice-gripper according to claim 1 wherein the downward end includes a foot member.

3. An ice-gripper according to claim 1 and further comprising:

a soft resilient covering provided over said ice-gripper member such that the ice-gripper is prevented from scratching surfaces and injuring beings which the ice-gripper may contact.

4. An ice-gripper according to claim 2 and further comprising:

a soft resilient covering over the outside periphery of the tubular gripper member such that the ice-gripper is prevented from scratching surfaces and injuring beings which the ice-gripper may contact.

5. A walking-aid having first and second ends comprising:

a walking cane having two ends with an outside periphery about one of said ends;

a tubular gripper member of hard material sized and shaped to fit over said outside periphery of said one end and including;

a series of pointed edges provided circumferentially around one end of the tubular member;

a separate walking cane having a shaft and a soft foot; and a shaft attachment means for attachment of the shaft of the walking cane to the shaft of the separate walking cane in back-to-back relationship such that there is a normally soft foot at said first end of said walking aid and an ice-gripper foot at said second end of said walking aid and a respective handle for each at said first and second ends of said walking aid.

6. A walking-aid according to claim 5 wherein the means for attachment of the shaft from the walking cane to the shaft of the separate walking cane is comprised of clamps to which both shafts are bolted; and a soft and resilient covering over said shaft attachment means.

7. A walking-aid according to claim 5 wherein said shaft attachment means is comprised of threaded band-type clamps.

8. A walking-aid according to claim 5 further comprising:

a cover placeable alternatively over either the gripper member or the soft foot.

9. A walking-aid according to claim 5 wherein the separate walking canes are crutch-type walking aids having an arm engaging support means.

10. A walking-aid according to claim 9 and further comprising said shaft attachment means permitting adjusting the distance of the arm-engaging support means of one cane from the foot or gripper means of the other cane whereby the effective height of the crutch may be adjusted.

11. An ice-gripper adapted to fit over one end of a walking cane having a ground engaging tip said ice-gripper comprising:

a solid tubular gripper member of hard material having a first and second ends and a base plate dividing said solid tube between said first and second ends, said first end sized and shaped to fit said ground engaging tip and having one or more linear openings extending from said first end towards said base and a ring-like strap sized to fit around said upper end of said solid tubular member and having means for compressing said first end of said solid tubular member over said group engaging tip; and said second end of said solid tubular member having an outwardly extending portion flairing outward from said base towards said second end of said solid tubular member and including a series of pointed edges formed circumferentially around the second end of said solid tubular member.

12. An ice-gripper for a walking aid having at least one ground engaging shaft said gripper comprising:

a solid tubular gripper member of hard material having an internal base dividing said gripper member into an upper section and a lower section, said upper section being sized and shaped to fit over the ground engaging shaft, and being provided with at least one orifice positioned to permit the use of a bolt to attach said upper section to said ground engaging shaft, and said lower section flaring outwardly from said base and including a series of pointed edges provided circumferentially about said lower section solid tube and formed by a series of cuts extending into said solid tube.

13. A walking-aid comprising a multi-legged walker including 4 vertical members each having a first and second ends, and frame members joining said vertical members to form said walker, said frame members including a first pair of handles adjacent said first ends and a second pair of handles adjacent said second ends of said vertical members, said vertical members being provided with ice-gripper members on said first ends and a soft foot on said second ends whereby said walking aid may be used in a first position with said ice-gripper members engaging a walking surface and with a user gripping said second handles, or the walking aid may be inverted whereby the user may grip the first handles and the soft feet will engage the walking surface.

* * * * *